US007169258B2

(12) United States Patent
Rheims et al.

(10) Patent No.: US 7,169,258 B2
(45) Date of Patent: Jan. 30, 2007

(54) PROCESS AND A FLUFFER DEVICE FOR TREATMENT OF A FIBER STOCK SUSPENSION

(75) Inventors: Jörg Rheims, Heidenheim (DE); Klaus Doelle, Menasha, WI (US); Oliver Heise, Menasha, WI (US); Werner Witek, Appleton, WI (US); Shawn Flanigan, Appleton, WI (US); Robert J. Matz, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/863,594

(22) Filed: May 23, 2001

(65) Prior Publication Data

US 2001/0045264 A1 Nov. 29, 2001

(30) Foreign Application Priority Data

May 26, 2000 (DE) ..... 100 26 304
Jul. 12, 2000 (DE) ..... 100 33 805

(51) Int. Cl.
*D21H 23/04* (2006.01)
*D21H 23/16* (2006.01)
*D21H 17/67* (2006.01)
*D21H 17/70* (2006.01)

(52) U.S. Cl. ..... 162/9; 162/26; 162/181.2; 162/181.4; 162/182

(58) Field of Classification Search ..... 162/181.2, 162/24–28, 90, 8–10, 70, 78, 158, 181.4, 162/182–185, 252, 261, 380; 106/461, 463, 106/464; 241/21, 28
See application file for complete search history.

(56) References Cited

U.S. PATENT DOCUMENTS

| | | | | |
|---|---|---|---|---|
| 3,725,193 | A * | 4/1973 | de Montigny et al. | 162/17 |
| 3,745,645 | A | 7/1973 | Kurth et al. | 29/530 |
| 4,055,903 | A * | 11/1977 | Hansen et al. | 34/380 |
| 4,229,250 | A | 10/1980 | Lehtinen | 162/26 |
| 4,510,020 | A * | 4/1985 | Green et al. | 162/169 |
| 5,096,539 | A * | 3/1992 | Allan | 162/9 |
| 5,223,090 | A | 6/1993 | Klungness et al. | 162/9 |
| 5,275,699 | A * | 1/1994 | Allan et al. | 162/181.2 |
| 5,314,583 | A | 5/1994 | Kappel | 162/25 |
| 5,324,389 | A | 6/1994 | Spencer | 162/4 |
| 5,626,300 | A | 5/1997 | Kohler | 241/247 |
| 5,630,909 | A | 5/1997 | LaRiviere | 162/243 |
| 5,665,205 | A * | 9/1997 | Srivatsa et al. | 162/181.4 |

(Continued)

FOREIGN PATENT DOCUMENTS

DE 40 25 616 C2 11/1999

(Continued)

*Primary Examiner*—Eric Hug
(74) *Attorney, Agent, or Firm*—Taylor & Aust, P.C.

(57) ABSTRACT

A device treats a fiber stock suspension with at least one additive, the fiber stock suspension being used for production of at least one of paper and cardboard. The fiber stock suspension includes a suspension medium and a fiber material. The fiber material has fiber surfaces, the fiber surfaces being moistened by the suspension medium. The device includes a fluffer having an inlet for receiving at least one of the fiber stock suspension and the at least one additive. The fluffer is coupled to the inlet, the fluffer being configured for separating the fiber material and enlarging a specific surface of the fiber surfaces.

18 Claims, 3 Drawing Sheets

U.S. PATENT DOCUMENTS 5,731,080 A * 3/1998 Cousin et al. ..... 428/372
5,810,973 A * 9/1998 Carlsmith et al. ..... 162/261
6,074,524 A * 6/2000 Wu et al. ..... 162/100
6,077,396 A * 6/2000 LaRiviere ..... 162/243
6,355,138 B1 * 3/2002 Doelle ..... 162/9
6,533,895 B1 * 3/2003 Doelle et al. ..... 162/9
6,706,148 B1 * 3/2004 Joisson et al. ..... 162/181.6

FOREIGN PATENT DOCUMENTS

GB 2 265 916 A 10/1993
WO WO 99/49133 9/1999
WO WO 99/54045 10/1999

* cited by examiner

PROCESS AND A FLUFFER DEVICE FOR TREATMENT OF A FIBER STOCK SUSPENSION

BACKGROUND OF THE INVENTION

1. Field of the Invention

The present invention relates to a process and device for the treatment of a fiber stock suspension, intended specifically for paper and/or cardboard production, and, more particularly, to a process of adding at least one additive thereto.

2. Description of the Related Art

The gentle handling of raw material resources necessitated specifically by economic and ecological reasons manifests itself in paper production in increasingly low basis weights of the paper web, as well as in partial replacement of the fiber stock by fillers. In order to achieve the strongest possible adhesion of the fillers onto the fiber surfaces, the latest appropriate treatment is a so-called "Fiber Loading™" process, as described in U.S. Pat. No. 5,223,090, which is hereby incorporated by reference. During such a "Fiber Loading™" process, at least one additive, specifically a filler, is added to the moistened fiber surfaces of the fiber material. The fibers may, for instance, be loaded with calcium carbonate. For this purpose calcium oxide and/or calcium hydroxide is added to the moist disintegrated fiber material, whereby at least a portion thereof may associate with the water that is present in addition to the fiber material. The fiber material treated in this manner is then supplied with pure carbon dioxide or with a medium containing carbon dioxide. Moreover, the resulting $CaCO_3$ may create a fiber stock suspension around the fibers.

Also, when loading the fibers with a particular additive or filler, the procedure as described in U.S. Pat. No. 5,223,090 may specifically be followed.

A pre-treatment of the paper suspension is necessary for the aforementioned "Fiber Loading™" process. However, the problem is that hitherto no optimally suitable machine was available for such a process.

SUMMARY OF THE INVENTION

The present invention provides a pretreatment process and device which is optimally suitable for the aforementioned "Fiber Loading™" process.

Relative to the process, the treatment of the fiber stock suspension occurs at least partially, in a fluffer, in which the fiber material of the fiber suspension is separated in a manner so as to increase the specific surface of the fiber material so that the accessibility for the educts to the fiber material surface is optimized.

The fluffer may be located prior to, as well as after, at least one reactor or similar device. The specific surface of the fiber stock suspension is enlarged in the fluffer, resulting in a marked homogenization improvement and "Fiber Loading™" process optimization.

A process optimization is achieved by dividing the fiber material using toothed disks and/or fluffer knives, whereby the specific surface of the fiber material is increased so that the accessibility for the educts to the fiber material surface is optimized.

The working area of the fluffer is preferably pressurized. The appropriate pressure value may specifically be in an approximate range of 0.1–20 bar.

Advantageously, fiber stock suspension volume and mass flow rate are adjustable within an approximate range of 5 tons per day to 1500 tons per day.

The temperature of the fiber stock suspension having been subjected to the pre-treatment is appropriately adjustable within an approximate range of 5° C. to 250° C.

In accordance with one advantageous form of the process according to the invention, an additive, for example PCC (precipitated calcium carbonate) or FLPCC™ (fiber loaded precipitated calcium carbonate), is added to the fiber stock suspension, at an approximate ratio of 15% to 40% and, preferably, of 20% to 25%.

An approximate pH value of 10 to 13 can be set for the fiber stock suspension, particularly prior to the reaction with the $CO_2$.

$CaCO_3$ may be added prior to, in and/or after the fluffer to the fiber stock suspension.

For the temperature of the $CaCO_3$, a preferred value of approximately −10° C. to approximately 250° C. is selected.

In principle it is also possible to add $Ca(OH)_2$ (slaked lime) to the fiber stock suspension prior to, in and/or after the fluffer.

The $Ca(OH)_2$ may be added specifically at a ratio of approximately 1% to approximately 60%.

The lime particle surface may, for example, be selected to be larger than 30,000 $cm^2/g$.

The width of the nip between the fluffer disks is adjustable, preferably within a range of approximately 0.1 mm to approximately 100 mm.

The energy requirement is selected to be, preferably, within a range of approximately 5 kWh/t to approximately 200 kWh/t.

The device of the present invention comprises, in one form thereof, a fluffer that is equipped with a fiber stock suspension infeed device and that is configured for separating the fiber suspension's fiber material in a manner so as to enlarge the specific surface of the fiber material so that accessibility for the educts to the fiber surface is optimized.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
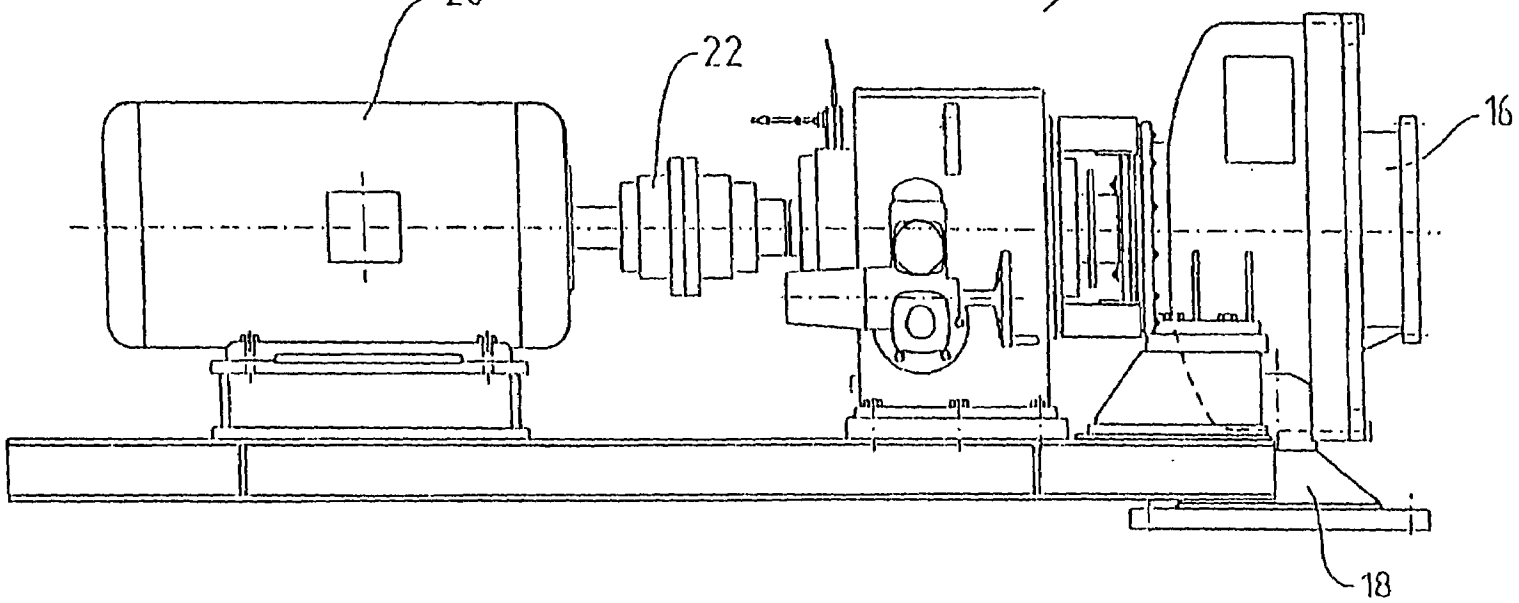
FIG. 1 is a schematic side view of a fluffer intended for pre-treatment of a fiber stock suspension, with corresponding drive motor.
Figure 2:
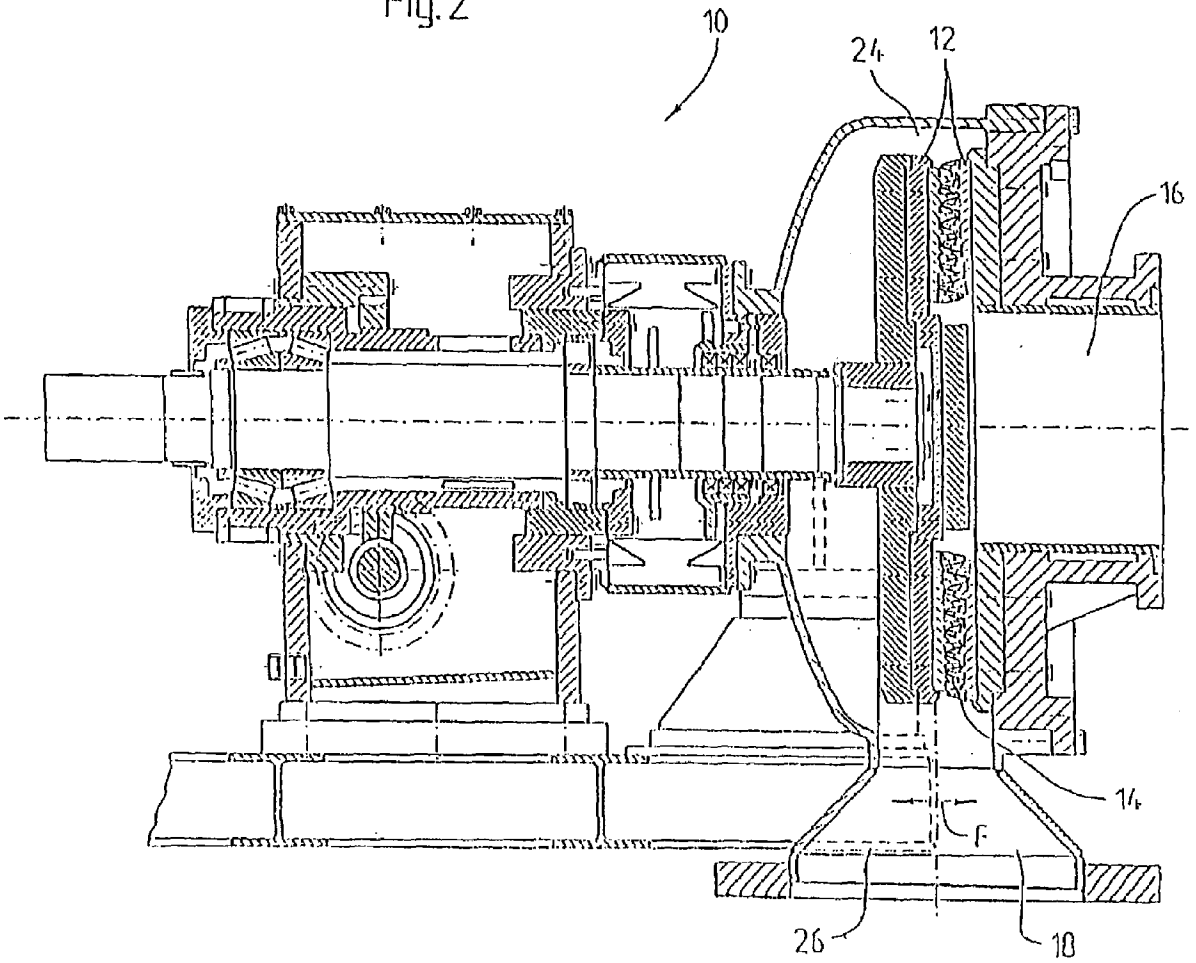
FIG. 2 is a schematic sectional illustration of the fluffer, according to FIG. 1.

FIGS. 1 and 2 are a schematic depiction of a fluffer 10, that is intended for the pretreatment of a fiber stock suspension, specifically in paper and/or cardboard production. The relevant treatment serves the addition of at least one additive, specifically a filler, on the moistened fiber surfaces of the fiber material. This loading of the fibers with additives, or fillers, may occur specifically in accordance with the aforementioned "Fiber Loading™" process.

Fluffer 10 includes fluffer disks 12 which are equipped with one or more tooth patterns and/or knives. Between adjoining fluffer disks 12, a gap 14 is formed in which the fiber material of the fiber stock suspension is divided in order to enlarge the specific surface of the fiber material. By such enlargement, the accessibility for the educts to the fiber material surface is optimized. Knives may be provided alternatively or in addition to one or more tooth patterns.

The fiber stock suspension is supplied to fluffer 10 through an inlet 16.

The fluffer 10 also includes, preferably, a variably adjustable fiber stock suspension outlet 18.

In the present example inlet 16 is positioned horizontally. In contrast, the fiber stock suspension, which is pre-treated in fluffer 10, is discharged vertically downward through outlet 18.

Fluffer 10 is connected to and driven by an electric motor 20 (see FIG. 1) via a coupling 22.

Operating or working area 24 of fluffer 10 can be put under pressure. The preferably variably adjustable pressure value may, for example, be in the approximate range of 0.1 to 20 bar.

The volume and mass flow rate of the fiber stock suspension are adjustable, for example, within a range of approximately 5 tons per day to approximately 1500 tons per day.

The temperature of the fiber stock suspension that was pre-treated in fluffer 10 may, for example, be adjustable within a range of approximately 5° C. to approximately 250° C.

An additive, for example PCC (precipitated calcium carbonate) or FLPCC™ (fiber loaded precipitated calcium carbonate), is added to the fiber stock suspension at an approximate ratio of 15% to 40%, and preferably at a ratio of approximately 20% to approximately 25%.

The treatment of the fiber stock suspension may, for example, be conducted so that a pH-value of approximately 10 to approximately 13 is set prior to the reaction with the $CO_2$.

Specifically, $CaCO_3$ may be added prior to, in and/or after fluffer 10 to the fiber stock suspension. The temperature of the $CaCO_3$ may, for example, be approximately −10° C. to approximately 250° C.

It is also possible to add $Ca(OH)_2$ (slaked lime) to the fiber stock suspension prior to, in and/or after fluffer 10.

The $Ca(OH)_2$ may be added specifically at a ratio of approximately 1% to approximately 60%.

A lime particle surface larger than 30,000 $cm^2/g$ would preferably be selected.

The width of nip 14 between fluffer disks 12 is adjustable, for example, within a range of approximately 0.1 mm to approximately 100 mm. A pusher 26 may be provided for this purpose, which would be adjustable in the direction of double arrow F (see FIG. 2).

The energy requirement is preferably within an approximate range of 5 kWh/t to 200 kWh/t.

Figure 3:
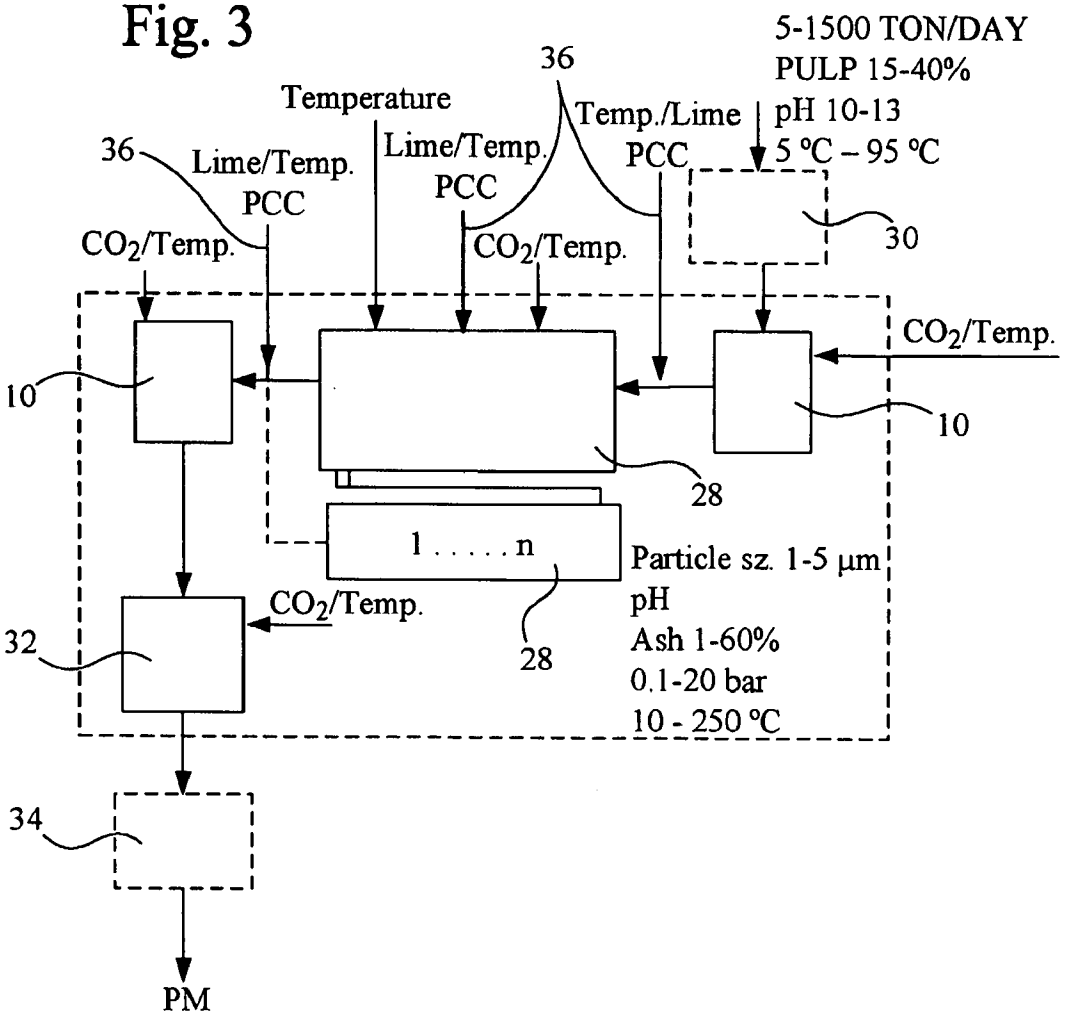
FIG. 3 is a schematic illustration of an example, comprising at least one Fluffer, preferably an arrangement according to FIG. 1, and intended specifically for a so-called "Fiber Loading™" process.

FIG. 3 is a schematic illustration of an example arrangement including at least one fluffer 10, intended specifically for a so-called "Fiber Loading™" process. Each fluffer 10 may be designed in the manner illustrated with FIGS. 1 and 2. Fluffer 10 may be located either prior to or after at least one reactor 28, 28'. One fluffer 10 is located between a refiner 30 and at least one reactor 28, 28'. Alternatively or additionally, it is also possible to position such fluffer 10 between at least one reactor 28, 28' and a tank 32. A refiner 34 is located again after tank 32, then leading into paper machine PM. Additionally or alternatively, at least one additive infeed 36 (shown schematically) can be provided, each of which is coupled with one of inlet 16 and fluffer 10 to supply a flow of at least one additive thereto. All other details in FIG. 3 are merely exemplary in nature.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT DESCRIPTION

10 Fluffer
12 Fluffer disks
14 Nip
16 Fiber stock suspension-inlet
18 Fiber stock suspension-outlet
20 Electric motor
22 Coupling
24 Operating area
26 Pusher
28 Reactor
28' Reactor
30 Refiner
32 Tank
34 Refiner
36 Additive Infeed
F Double arrow
PM Paper machine

What is claimed is:

1. A process of treating a fiber stock suspension to produce at least one of paper and cardboard having filled fibers therein, said process comprising the steps of:

providing the fiber stock suspension, with a moistened fiber material having fiber surfaces, said stock suspension having a stock pH associated therewith, said stock pH being set in an approximate range of 10 to 13;

adding at least one additive to the fiber suspension, including at least $CaCO_3$;

treating the fiber suspension and the at least one additive together in a fluffer operated under fiber stock fluffing conditions;

separating the fiber material within said fluffer so as to increase a specific surface thereof, thereby optimizing accessibility of educts to the fiber surfaces;

filling fibers within the fiber stock suspension with said additive to form filled fibers; and passing the treated fiber stock suspension to a paper machine and forming the at least one of paper and cardboard with the treated fiber stock suspension.

2. The process of claim 1, wherein one said additive is a filler incorporated onto the fiber surfaces during said separating step.

3. The process of claim 1, wherein said fluffer separates the fiber material into individual fibers.

4. The process of claim 1, wherein said fluffer is used for pre-treating the fiber stock suspension prior to said step of adding at least one additive to the fiber suspension.

5. The process of claim 1, wherein the fluffer has a working area which is pressurized.

6. The process of claim 5, wherein a pressure in said working area is within an approximate range of 0.1 to 20 bar.

7. The process of claim 1, wherein said process has a volume and mass flow rate associated therewith, said volume and mass flow rate being adjustable within an approximate range of 5 tons/day to 1500 tons/day.

8. The process of claim 1, wherein said fiber stock suspension within said fluffer has a stock temperature, the stock temperature being capable of being regulated within an approximate range of 5° C. to 250° C.

9. The process of claim 1, wherein the at least one additive is added to the fiber stock suspension at an approximate ratio of 15% to 40%.

10. The process of claim 9, wherein the at least one additive is added to the fiber stock suspension at an approximate ratio of 20% to 25%.

11. The process of claim 1, said $CaCO_3$ being added to the fiber stock suspension at least one of prior to, in and after said fluffer.

12. The process of claim 11, wherein said $CaCO_3$ has temperature selected to be in an approximate range of −10° C. to 250° C.

13. The process of claim 1, wherein said process has an energy requirement associated therewith, said energy requirement being selected from an approximate range of 5 kWh/t to 200 kWh/t.

14. A process of treating a fiber stock suspension for at least one of paper and cardboard production, said process comprising the steps of:

providing the fiber stock suspension, with a moistened fiber material having fiber surfaces, said stock suspension having a stock pH associated therewith, said stock pH being set in an approximate range of 10 to 13;

adding at least one additive to the fiber suspension, including at least $CaCO_3$;

treating the fiber suspension and the at least one additive together in a fluffer operated under fiber stock fluffing conditions;

separating the fiber material within said fluffer so as to increase a specific surface thereof, thereby optimizing accessibility of educts to the fiber surfaces;

passing the treated fiber stock suspension to a paper machine and producing the at least one of paper and cardboard with the treated fiber stock suspension; and wherein said fluffer is comprised of at least one of knives and toothed fluffer disks.

15. The process of claim 14, wherein said fluffer includes at least one pair of adjoining fluffer disks, each pair of adjoining fluffer disks defining a nip, each nip having a nip width, said nip width being adjustable within a range of about 0.1 mm to about 100 mm.

16. A process of treating a fiber stock suspension for at least one of paper and cardboard production, said process comprising the steps of:

providing the fiber stock suspension, with a moistened fiber material having fiber surfaces, said stock suspension having a stock pH associated therewith, said stock pH being set in an approximate range of 10 to 13;

adding at least one additive to the fiber suspension, including at least $CaCO_3$;

treating the fiber suspension and the at least one additive together in a fluffer operated under fiber stock fluffing conditions;

separating the fiber material within said fluffer so as to increase a specific surface thereof, thereby optimizing accessibility of educts to the fiber surfaces;

passing the treated fiber stock suspension to a paper machine and producing the at least one of paper and cardboard with the treated fiber stock suspension; and wherein one said step of adding at least one additive includes adding $Ca(OH)_2$, said $Ca(OH)_2$ being added to the fiber stock suspension at least one of prior to, in and after said fluffer.

17. The process of claim 16, wherein said $Ca(OH)_2$ is added at an approximate ratio of 1% to 60%.

18. The process of claim 16, wherein said $Ca(OH)_2$ has a particle surface of greater than 30,000 $cm^2/g$.

* * * * *